US006263594B1

(12) United States Patent
Jantzen

(10) Patent No.: US 6,263,594 B1
(45) Date of Patent: Jul. 24, 2001

(54) DREDGING SYSTEM

(76) Inventor: Robert J. Jantzen, 6655 Amberton Dr., Elkridge, MD (US) 21075

( * ) Notice: Subject to any disclaimer, the term of this patent is extended or adjusted under 35 U.S.C. 154(b) by 0 days.

(21) Appl. No.: 09/398,710

(22) Filed: Sep. 20, 1999

Related U.S. Application Data

(60) Provisional application No. 60/113,895, filed on Dec. 28, 1998.

(51) Int. Cl.[7] ..... E02F 3/90

(52) U.S. Cl. ..... 37/335; 37/346; 37/307

(58) Field of Search ..... 37/307, 309, 317, 37/335, 336, 334, 346

(56) References Cited

U.S. PATENT DOCUMENTS 3,757,369 * 9/1973 Laarman ..... 37/317
3,812,922 * 5/1974 Stechler ..... 175/6
3,919,791 * 11/1975 Smith ..... 37/67
4,087,981 * 5/1978 Norman ..... 37/60
4,108,499 * 8/1978 Sandberg ..... 37/58
4,242,816 * 1/1981 Jeanson ..... 37/67
4,696,607 * 9/1987 Ressi Di Cervia ..... 405/267
5,285,587 * 2/1994 Krenzler ..... 37/323
5,491,913 * 2/1996 Hutchinson ..... 37/311
5,913,604 * 6/1999 Brouwer et al. ..... 37/355

* cited by examiner

*Primary Examiner*—Thomas B. Will
*Assistant Examiner*—Kristine Markovich
(74) *Attorney, Agent, or Firm*—Banner & Witcoff, Ltd.

(57) ABSTRACT

The present invention is useful for dredging underneath a floating vessel, where a conventional dredge cannot reach the location of the material to be dredged. A neutral buoyancy pipe is attached to the end of the suction pipe and acts as an extension of the suction pipe. The vertical position of the neutral buoyancy pipe is controlled by adjusting the buoyancy of the neutral buoyancy pipe. The horizontal position of the neutral buoyancy pipe is controlled both by the anchoring system which sweeps the dredge back and forth and by a position adjusting system at the forward end of the neutral buoyancy pipe.

2 Claims, 4 Drawing Sheets

DREDGING SYSTEM

CROSS-REFERENCE TO RELATED APPLICATION

This invention is disclosed in part in my co-pending Provisional U.S. patent application entitled DREDGING SYSTEM, Ser. No. 60/113,895, filed on Dec. 28, 1998, the priority of which is claimed for the common subject matter.

BACKGROUND OF THE INVENTION

The conventional dredge rotates on a vertical spud driven into the bottom of the channel in which the dredge is operating. A ladder extending from the front of the dredge supports a suction pipe, which is conventionally made of steel. Slightly in front of the suction pipe is a rotating cutter. The ladder swings vertically. When the ladder is swung down about 45 degrees the ladder is near its maximum angle for digging a channel.

SUMMARY OF THE INVENTION

The present invention is useful for dredging underneath a floating vessel, where a conventional dredge cannot reach the location of the material to be dredged. A neutral buoyancy pipe is attached to the end of the suction pipe and acts as an extension of the suction pipe. The vertical position of the neutral pipe is controlled by adjusting the buoyancy of the neutral buoyancy pipe. The horizontal position of the neutral buoyancy pipe is controlled both by the anchoring system which sweeps the dredge back and forth and by a position adjusting system at the forward end of the neutral buoyancy pipe.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

The invention will be better understood and the objects other than those set forth above will become apparent when consideration is given to the following detailed description thereof. Such description makes reference to the annexed drawings wherein.

DESCRIPTION OF THE PREFERRED EMBODIMENTS

Figure 1:
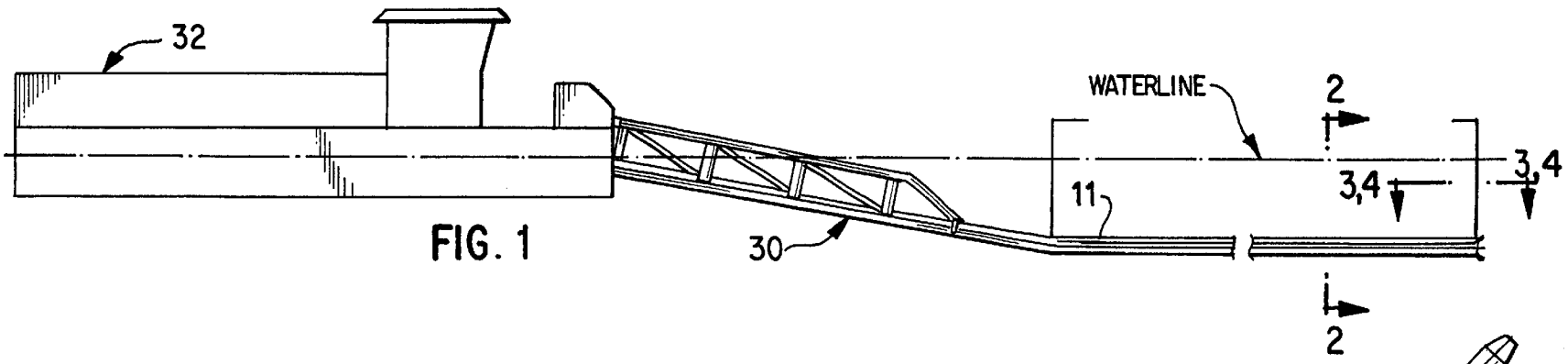
FIG. 1 is a side view of a dredge with the present invention attached.
Figure 3:
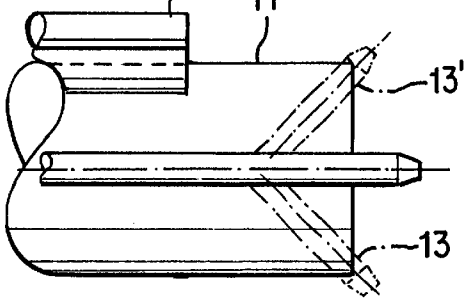
FIG. 3 is a sectional side view taken on lines 3—3 of FIG. 1.
Figure 2:
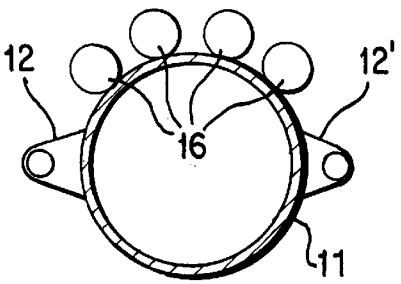
FIG. 2 is a sectional end view taken on lines 2—2 of FIG. 1.
Figure 4:
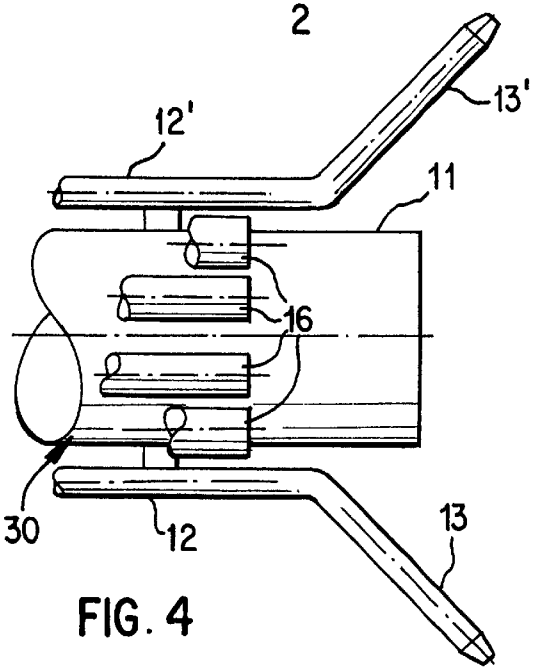
FIG. 4 is a sectional top view taken on lines 4—4 of FIG. 1.
Figure 5:
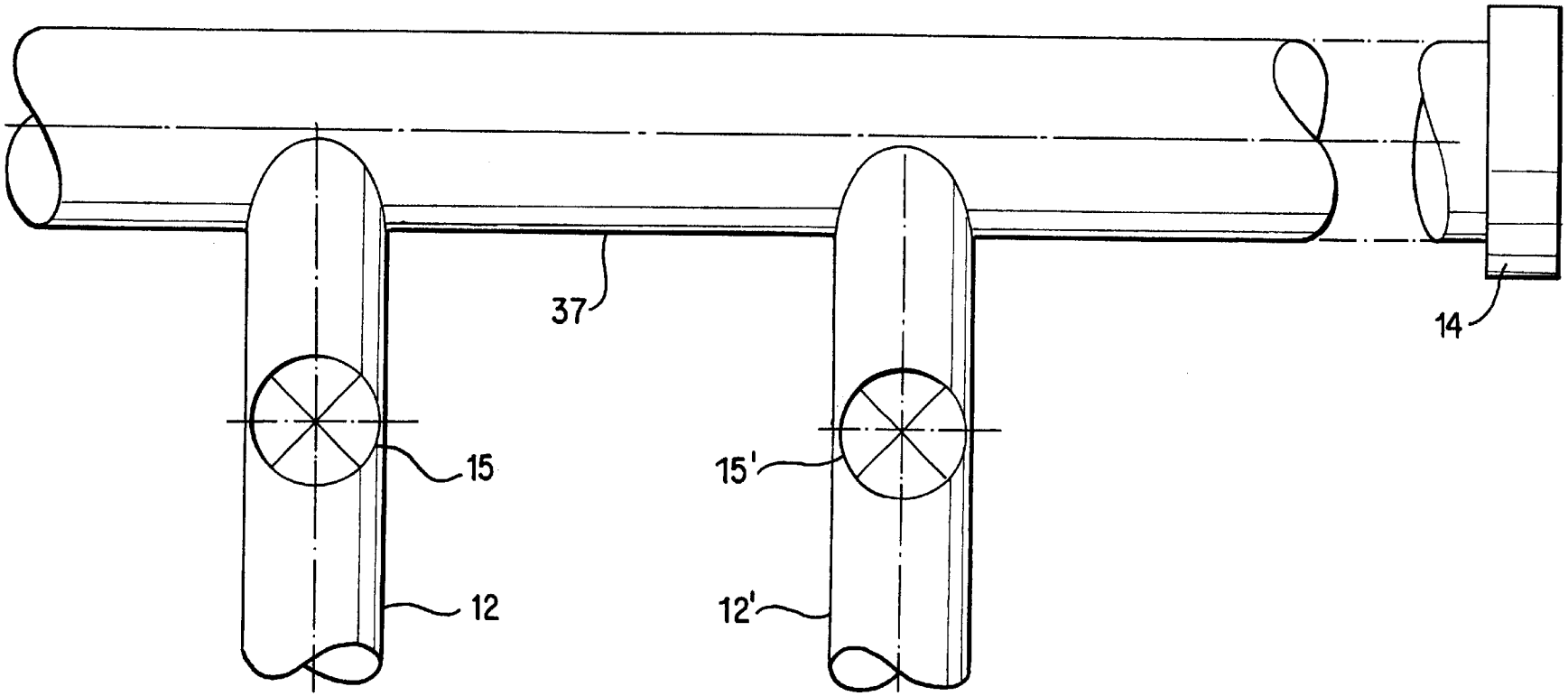
FIG. 5 is a top view of the rear portion of the directional control pipes.
Figure 6:
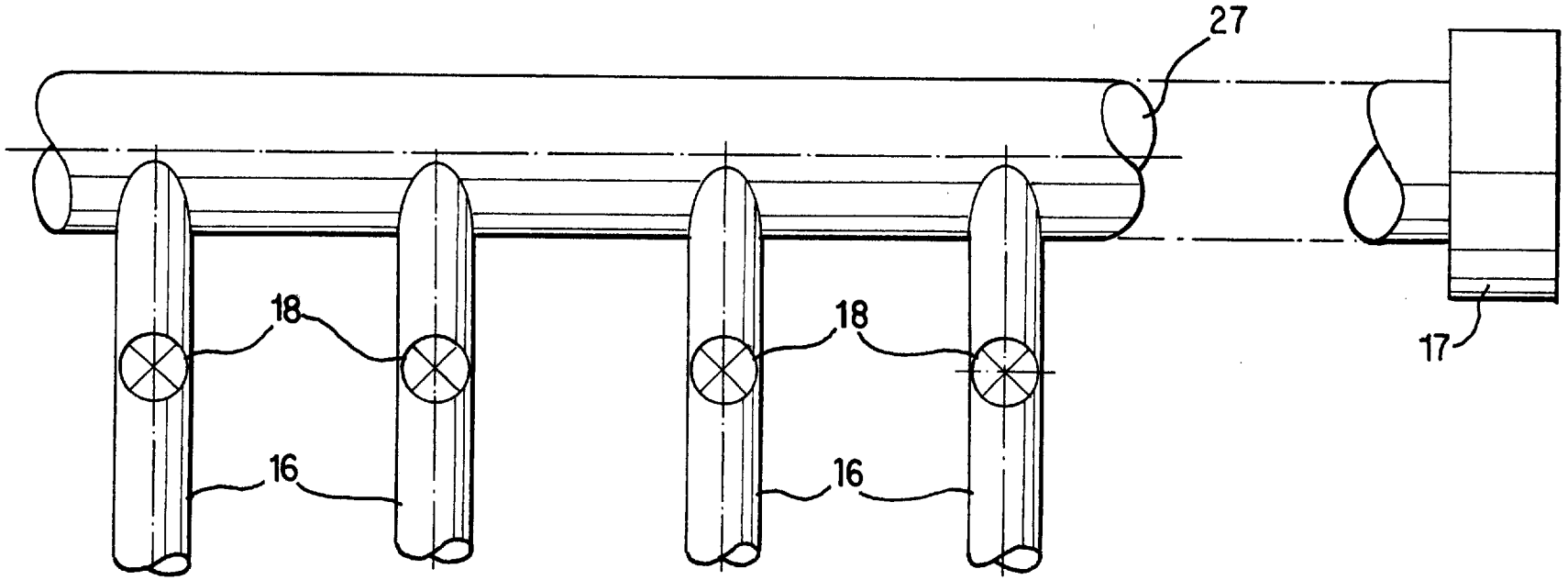
FIG. 6 is a top view of the rear portion of the buoyancy adjusting pipes.
Figure 7:
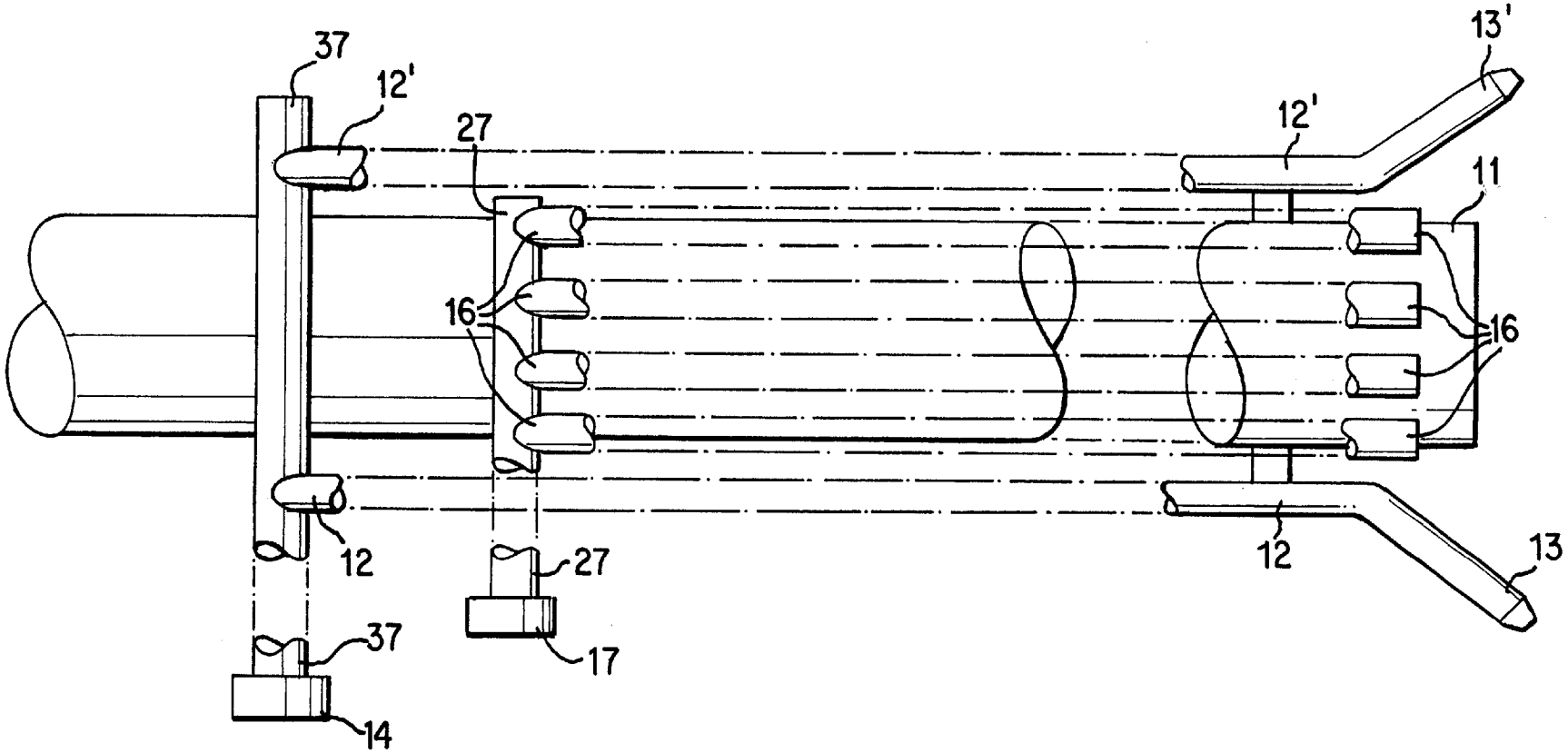
FIG. 7 is a partial top view of a forward portion of the present invention.

FIG. 1 illustrates a dredge 32 according to the present invention. Unlike conventional dredges, the cutter end of the dredge 32 is removed and a plastic pipe 11, of the desired size and length is installed. The pipe should be of a nearly neutral buoyancy in water, so that when it fills with water it will retain that neutral buoyancy. One such pipe is Extra High Density Polyethylene Pipe, SDR 17, 16" OD with a wall thickness of 0.941", and a density of 0.95.

Outside the large pipe 11 are two small position adjusting 3" plastic pipes 12, 12', running the length of pipe 11 for controlling the direction that the pipe 11 travels. These two small pipes 12, 12' supply water to angled nozzles 13, 13', at the ends of the small pipes. The nozzles are angled outwardly about 45 degrees, and may be adjusted upwardly or downwardly. The rear ends of the directional control pipes 12, 12', are attached to a pipe 37 that is connected to a source of pressured water 14, through two vales 15, 15'.

On top of the large pipe 11 are four 4" buoyancy adjusting plastic pipes 16, running the length of pipe 11. The plastic pipes 16 can be 4" SDR 21 pipes used for flotation. These small pipes are connected at the dredge end to four valves 18, which are connected to a common air line 27 supplied by a compressor 17.

In operation, the large plastic pipe 11 is pushed forward. It is rigid enough so that it does not buckle as it is pushed into position. The buoyancy of the entire pipe system, including the large pipe and all of the small pipes and attachments, is adjusted to a slight positive buoyancy so that the pipe 11 rests lightly on the surface of the water or the bottom of the floating vessel, and not on the surface of the bottom of a dredging zone, if it is lower.

This adjustment can be made in several ways. First, small weights may be attached to the pipe system to set the maximum buoyancy of the pipe system. Second, the nozzles 13, 13' may be adjusted before the dredging starts, to set the initial buoyancy. Third, each of the four buoyancy adjusting pipes 16, may be filled with air, or filled with water to set any one of four stages of buoyancy during operation.

In operation, the water jets exiting from nozzles 13, 13', substitute for the cutter in loosening the material near the forward end of the large plastic pipe 11, which is an extension of the suction pipe 30. The plastic pipe system is swung from side to side, as with a conventional dredge, with the end of the plastic pipe system driven from side to side by varying the flow to the two directional control 3" plastic pipes 12, 12', by varying the flow to the two water nozzles 13, 13'. As each cut is completes, the pipe system is depressed to rest on the newly exposed bottom surface.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A dredging system for dredging underneath a floating vessel, comprising in combination, a) a floating dredge;

b) a suction pipe attached to a front end of the dredge and being rotatable in a vertical plane from horizontal to a depressed position;

c) a large plastic pipe of essentially neutral buoyancy, a back end of said large plastic pipe attached to an end of the suction pipe, so that the suction pipe pumps water and loosened material at the front end of the large plastic pipe;

d) a pair of small position adjusting pipes attached to the sides of the large plastic pipe, said pair of small position adjusting pipes terminating in a pair of nozzles, said nozzles being adjustable in the vertical and the horizontal plane;

e) the small position adjusting pipes connected to a water supply through a pair of valve, the horizontal position of the end of the large plastic pipe controlled by adjusting the relative amount of water passing through each nozzle;

f) a buoyancy adjusting pipe running the length of the large plastic pipe, with an aperture at the front end, and attached at the rear end, through a valve, to a source of compressed air; and g) the buoyancy of the large plastic pipe and the position adjusting and buoyancy adjusting pipes are controlled by admitting water into the buoyancy adjusting pipe and by expelling the water by filling the buoyancy adjusting pipe with air;

whereby the dredge may push the large plastic pipe underneath the floating vessel, and sweep the front end of the large plastic pipe back and forth by controlling the relative amount of water passed through the two position adjusting pipes, and adjusting the relative buoyancy of the large plastic pipe by controlling whether air or water is in the buoyancy adjusting pipe.

2. The combination of claim 1 wherein there are a plurality of buoyancy adjusting pipes.

* * * * *